US006647965B1

(12) United States Patent
Breeden

(10) Patent No.: US 6,647,965 B1
(45) Date of Patent: Nov. 18, 2003

(54) PUMP ASSEMBLY AND METHOD

(76) Inventor: Robert H. Breeden, 732 Beechwood Dr., Wooster, OH (US) 44691-2747

( * ) Notice: Subject to any disclaimer, the term of this patent is extended or adjusted under 35 U.S.C. 154(b) by 0 days.

(21) Appl. No.: 10/338,281

(22) Filed: Jan. 8, 2003

(51) Int. Cl.[7] ..... F02M 37/04

(52) U.S. Cl. ..... 123/446; 123/496; 137/625.18; 137/596.16; 137/625.61

(58) Field of Search ..... 123/446, 456, 123/496, 457, 357; 137/12, 625.18, 115, 625.63, 625.61, 625.64, 625.66, 596.1, 596.13, 596.14, 596.16; 417/289, 295, 490; 91/420, 421

(56) References Cited

U.S. PATENT DOCUMENTS

| | | | | | |
|---|---|---|---|---|---|
| 3,820,920 | A | | 6/1974 | Klimaszewski et al. | 417/213 |
| 4,114,643 | A | * | 9/1978 | Aoyama et al. | 137/495 |
| 4,411,189 | A | * | 10/1983 | Miller | 91/420 |
| 4,741,248 | A | * | 5/1988 | Budzich | 91/421 |
| 4,840,031 | A | * | 6/1989 | Hribar | 60/338 |
| 4,873,817 | A | | 10/1989 | Harms | 56/10.2 |
| 5,191,867 | A | | 3/1993 | Glassey | 123/446 |
| 5,515,829 | A | | 5/1996 | Wear et al. | 123/446 |
| 5,800,130 | A | | 9/1998 | Blass et al. | 417/213 |
| 5,806,565 | A | * | 9/1998 | Kadlicko | 137/625.63 |
| 6,162,022 | A | | 12/2000 | Anderson et al. | 417/213 |
| 6,293,253 | B1 | | 9/2001 | Arnold et al. | 123/458 |
| 6,345,608 | B1 | | 2/2002 | Rembold et al. | 123/506 |
| 6,439,199 | B2 | | 8/2002 | Ramseyer et al. | 123/446 |
| 6,460,510 | B1 | | 10/2002 | Breeden | 123/446 |
| 6,468,046 | B1 | | 10/2002 | Du et al. | 417/222.1 |
| 2002/0000247 | A1 | | 1/2002 | Cusac et al. | 137/375 |
| 2002/0034448 | A1 | | 3/2002 | DeMatthaeis | 417/295 |

FOREIGN PATENT DOCUMENTS

| | | |
|---|---|---|
| DE | 35 09 856 | 10/1985 |
| DE | 34 38 015 | 4/1986 |
| JP | 58-222988 | 12/1983 |
| JP | 58-222990 | 12/1983 |

* cited by examiner

*Primary Examiner*—Carl S. Miller
(74) *Attorney, Agent, or Firm*—Hooker & Habib, P.C.

(57) ABSTRACT

A pump assembly and method for an internal combustion engine includes a high-pressure pump for pressurizing oil used to actuate fuel injectors or other devices, a hydraulic inlet throttle valve, a three-way valve for alternatively connecting the inlet throttle valve to output pressure or to the sump and a solenoid responsive to signals from an electronic control module for shifting the three-way valve.

39 Claims, 5 Drawing Sheets

PUMP ASSEMBLY AND METHOD

FIELD OF THE INVENTION

The invention relates to pump assemblies and pumping methods for internal combustion engines where the liquid pumped by the assembly is used to actuate hydraulically driven devices, typically fuel injectors, intake and exhaust valves, and engine brakes.

DESCRIPTION OF THE PRIOR ART

Diesel engines using hydraulically actuated devices including fuel injectors, intake and exhaust valves and engine brakes are well known. The hydraulically actuated devices each include an actuation solenoid, which, in response to a signal opens a valve for an interval to permit high-pressure liquid supplied to the device to extend a piston and actuate the device.

U.S. Pat. No. 6,460,510 discloses a pump assembly for a diesel engine with hydraulically actuated fuel injectors including a high-pressure pump for pumping high-pressure engine oil to the injectors, a hydraulic inlet throttle valve for controlling inlet flow of low-pressure engine oil to the pump and a hydraulic circuit for opening and closing the inlet throttle valve in response to signals from an engine control module (ECM) proportional to the difference between measured pump outlet pressure and desired outlet pressure as determined by the ECM.

The inlet throttle valve includes a spool and a spring that biases the spool toward a full open position. A piston on the spool forms one wall of a pressure chamber which is connected to an injection pressure regulator (IPR) valve and is also vented to the sump through a restriction. High-pressure output oil is flowed to the chamber by the IPR valve to shift the spool against the spring toward the closed position. The pressure drop across the restriction prevents pressurizing the chamber at full output pressure. Additionally, when the ECM determines the output pressure must be increased, the restriction prevents rapid flow of oil out from the pressure chamber and slows opening movement of the spool. Rapid opening and closing response of the inlet throttle valve to signals to increase or decrease output pressure is desirable.

The pump assembly of U.S. Pat. No. 4,460,510 is particularly adapted to controlling the output pressure of oil used to actuate fuel injectors for a diesel engine which is operated primarily at high engine speed, such as an engine in an over-the-road truck.

Accordingly, there is a need for an improved pump assembly with a hydraulic inlet throttle valve and method for flowing engine oil to a high-pressure pump for an internal combustion engine where the pump assembly responds rapidly and accurately to ECM signals, particularly when the engine is at low speed or idling and output pressure is low. The pump assembly should be capable of rapidly opening or closing the inlet throttle valve to increase or decrease the flow of low-pressure oil to the pump and rapidly increase or decrease the output pressure. The assembly should improve the stability of the inlet throttle valve by damping the effect of output pressure spikes on the inlet throttle valve. The inlet throttle valve should respond directly to full output pressure when a decrease in output pressure is required and should drain oil directly to the sump, without flow restriction, when increased output pressure is required. Operation of the inlet throttle valve by high output pressure oil should not damage the valve.

There is also a need for a pump assembly and method for an internal combustion engine with improved fuel efficiency, particularly when the engine is operating at low speed or idling.

SUMMARY OF THE INVENTION

The invention comprises a pump assembly and method for actuating a fuel injector, intake or exhaust valve, engine brake or other member in an internal combustion engine. The pump assembly has a high-pressure variable output pump and a hydraulically actuated inlet throttle valve for the pump. The inlet throttle valve has a valving spool that is biased toward an open position by a spring and by inlet pressure. The spool is biased toward a closed position by high-pressure oil from the pump.

The pump assembly includes a three-way valve responsive to a signal from the ECM to rapidly open or close the inlet throttle valve. The inlet throttle valve is rapidly closed by oil at full output pressure. The inlet throttle valve is rapidly opened by a spring and inlet pressure while draining oil in the valve directly to the sump.

Connection of the inlet throttle valve to oil at output pressure moves the valve spool in a closing direction responsive to the full output pressure, without pressure reduction due to flow of the oil to the sump through a restriction. The spool moves in an opening direction with direct drain to the sump, without flow through a restriction. In each case, response time for movement of the spool is reduced.

The inlet throttle valve includes a soft or hydraulic stop to prevent physical contact between the spool and the valve body when the valve is rapidly closed by flow from a full output pressure oil passage.

The three-way valve includes a spool having a valving land which moves across valving openings leading to the pressure chamber in the inlet throttle valve. When the inlet throttle valve is pressure balanced, the land is in a null position, overlies the valving openings and the valving openings are underlapped, permitting limited flow of high-pressure oil past the land and directly to sump. Underlapping damps spikes in output pressure by flowing oil directly to the sump and improves stability of the inlet throttle valve.

The pump assembly is designed for stable operation both at high engine speed with output pressure as high as 4,060 PSI and at low or idle engine speed where the output pressure may be as low as 360 PSI. This results in improved fuel economy, particularly in engines that frequently operate at low RPM or at idle.

Three embodiment pump assemblies are disclosed. In the first embodiment the three-way valve spool is biased against a spring and is shifted by hydraulic pressure. The hydraulic pressure is determined by flow through a solenoid controlled valve. In the second and third embodiments, the three-way valve spool is biased against a spring by a proportional solenoid. In all embodiments, the ECM sends a current signal to a solenoid that is influenced by the difference between the output pressure of the high-pressure pump and desired output pressure.

Other objects and features of the invention will become apparent as the description proceeds, especially when taken in conjunction with the accompanying drawings illustrating the invention.

DESCRIPTION OF THE PREFERRED EMBODIMENTS

Figure 1:
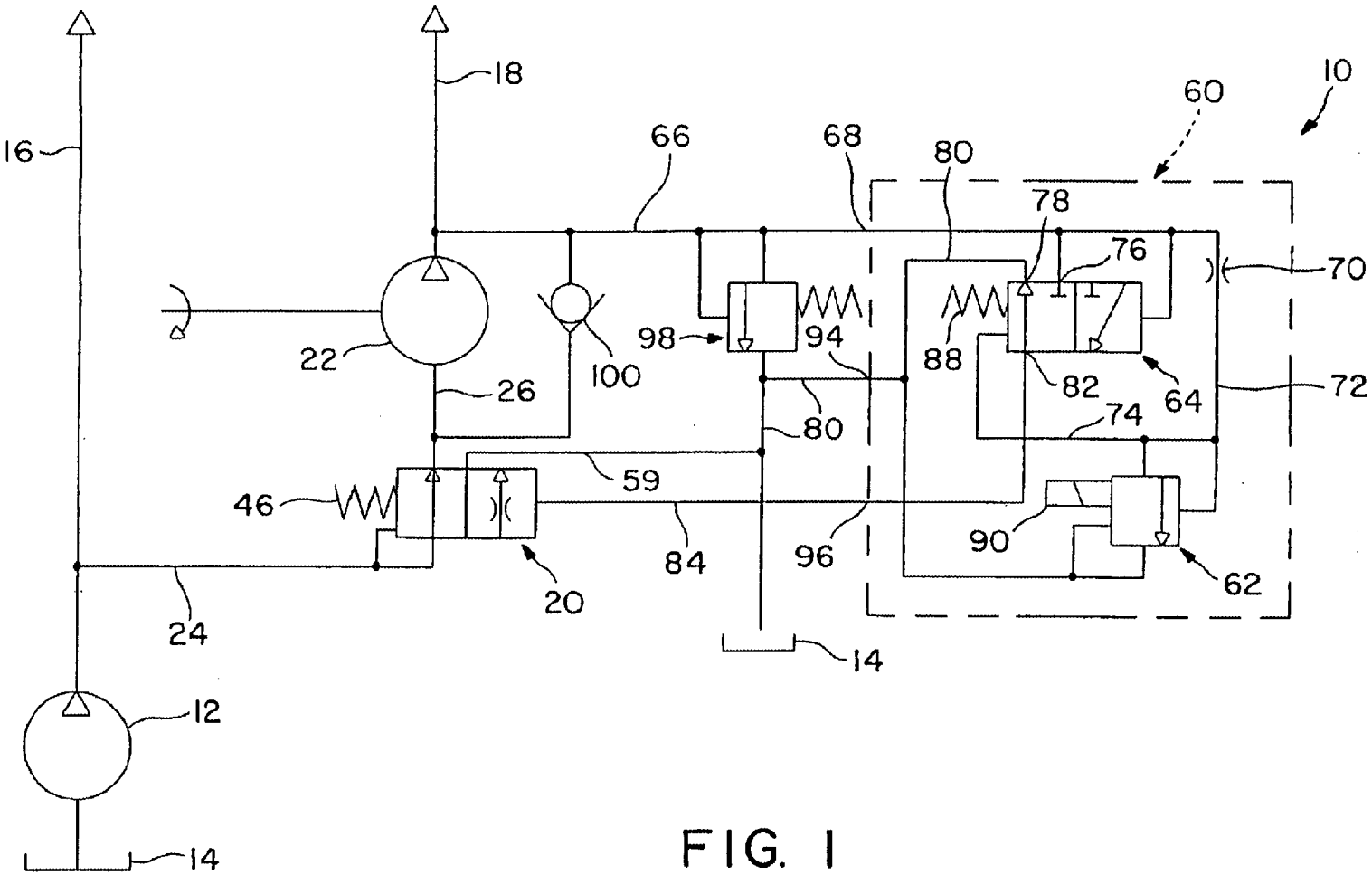
FIG. 1 is a diagram of the hydraulic circuitry of a first embodiment pump assembly.

First embodiment pump assembly 10 is a component of an internal combustion engine, typically a diesel engine, and provides high-pressure liquid, typically engine oil, for actuating fuel injectors for the engine. The assembly may also provide high-pressure liquid for actuating mechanisms for intake and exhaust valves or for other devices.

My U.S. Pat. No. 6,460,510 discloses a diesel engine with a pump assembly for hydraulically actuated fuel injectors which is related to assembly 10. The disclosure of U.S. Pat. No. 6,460,510 is incorporated herein by reference, in its entirety.

The diesel engine includes a low-pressure oil pump 12 which draws oil from sump 14 and flows the oil through low-pressure line 16 to engine bearings and cooling jets. The fuel injectors for the engine (not illustrated) are actuated by high-pressure engine oil supplied by assembly 10 through high-pressure outlet passage 18.

Assembly 10 includes hydraulically actuated inlet throttle valve 20 and variable output high-pressure pump 22. The pump may be identical to the pump disclosed in U.S. Pat. No. 6,460,510. Pump 22 is rotated by the engine. Branch low-pressure line 24 extends from line 16 to the inlet port of inlet throttle valve 20. Inlet passage 26 extends from the outlet port of the inlet throttle valve to the inlet port of pump 22. High-pressure outlet passage 18 is connected to the outlet port of pump 22.

Figure 4:
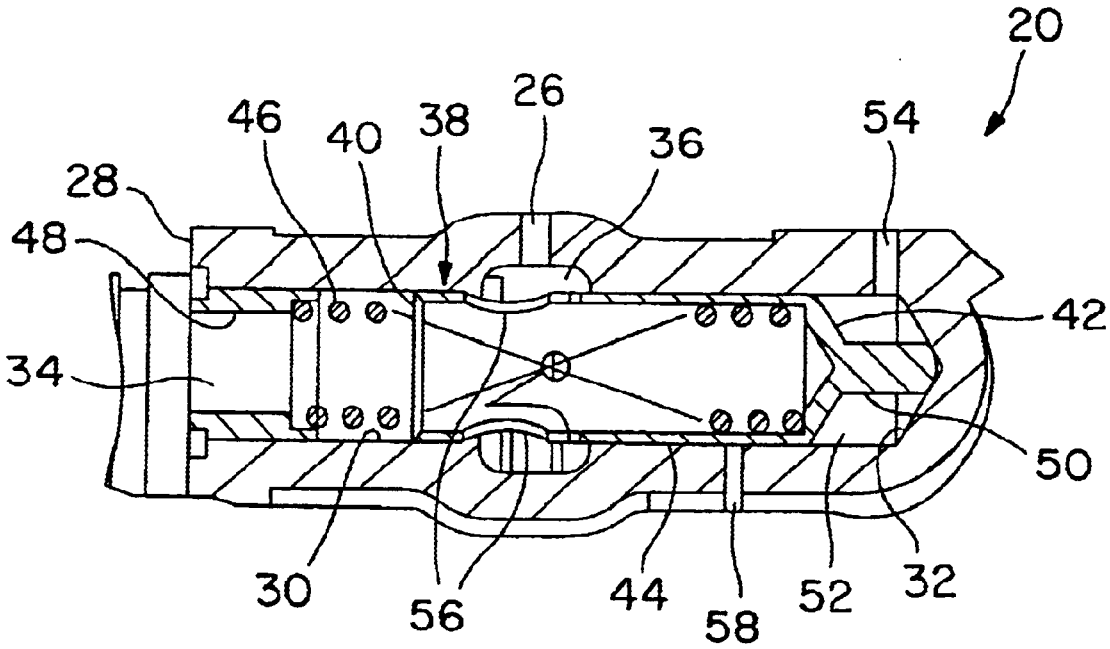
FIG. 4 is a sectional view through an inlet throttle valve.

Inlet throttle valve 20 is illustrated in FIG. 4. Valve 20 includes a body 28, which may be part of the body of high-pressure pump 22. Bore or passage 30 extends into body 28 to closed end 32. Low-pressure line 24 extends to oil inlet port 34 at the open end of bore 30. Inlet passage 26 extends to oil outlet port 36 which surrounds the bore 30 between the open and closed ends of the bore.

Hollow, cylindrical valving spool 38 has a close sliding fit in the bore permitting movement of the spool along the bore. Outer spool end 40 is open and inner piston end 42 is closed to form a piston. Cylindrical wall 44 extends between ends 40 and 42. Spring 46 is confined between retainer sleeve 48 at the open end of the bore and the piston end 42 of the spool to bias the spool toward closed end 32 of the bore. Locating post 50 extends inwardly from the closed end of, the spool to prevent the spool end from bottoming on the end of the bore and to define a hydraulic chamber 52 between piston end 42 and bore end 32. Chamber port 54 permits flow of oil into and from chamber 52.

A number of flow openings 56 extend through cylindrical wall 44. When the spool is in the full open position as shown in FIG. 4 the openings provide a large flow area communicating ports 34 and 36 for maximum flow of low-pressure oil to pump 22. High-pressure oil flowed into chamber 52, moves the spool away from closed end 32, against spring 46 and the inlet pressure of pump 12, and moves the flow openings past the oil outlet port to reduce the flow area through the inlet throttle valve and correspondingly reduce the volume of oil flowed to high-pressure pump 22.

Drain port 58 extends through body 28 to bore 30. When the spool is in the full open position, as shown in FIG. 4, wall 44 overlies port 58 and the piston end 42 is between the port and bore closed end 32. As oil in chamber 52 moves the spool away from the full open position the piston uncovers port 58 prior to engagement of the spool outer end 40 against retainer 48. When the piston uncovers the drain port the high-pressure oil in chamber 52 is flowed directly to sump 14 to stop closing movement of the spool and prevent contact between the spool end 40 and retainer 48. In this way, rapid movement of the spool toward the closed position by the high-pressure oil in chamber 52 is automatically slowed and stopped to prevent mechanical engagement between the spool and retainer. The drain port 58 forms a hydraulic stop, rather than mechanical stop, to cushion closing movement of the spool and prevent damage to the inlet throttle valve because of mechanical engagement between the spool and the retainer.

Port 34 opens into the interior of spool 38 so that the pressure of inlet oil in line 24 cooperates with spring 46 to bias the spool toward the open position. When chamber 52 is connected to the sump the inlet oil pressure and the spring rapidly open the valve. The flow area of the inlet throttle valve, and consequently the volume of low-pressure inlet oil flowed through passage 26 to pump 22, is determined by the position of spool 38 in bore 30.

Regulator valve 60 includes pilot relief valve 62 and main stage, three-way valve 64. High-pressure branch passage or line 66 extends from passage 18 through opening 68 of valve 60 to restriction 70. Passage or line 72 extends from the restriction to one end of pilot relief valve 62. Passage or line 74 extends from line 72 to the inlet port of valve 62 and to one end of main stage three-way valve 64. The other end of valve 64 is connected to line 66.

Valve 64 includes a high-pressure inlet port 76 connected to line 66, a drain port 78 connected to sump 14 through line 80 and a work port 82 connected directly to hydraulic chamber 52 in inlet throttle valve 20 through line 84. Drain port 58 in inlet throttle valve 20 is connected to sump 14 through lines 59 and 80.

Figure 2:
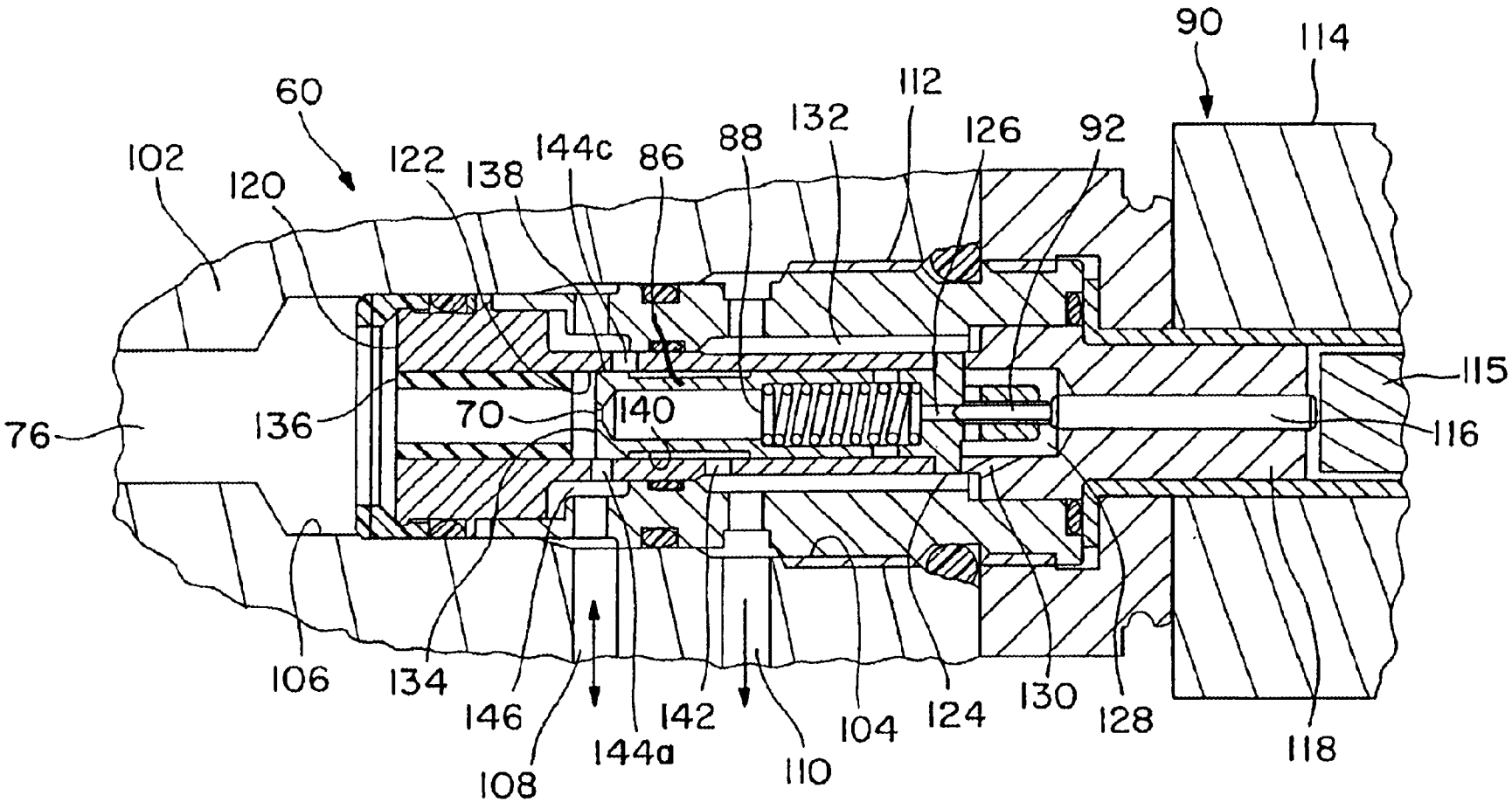
FIG. 2 is a sectional view, partially broken away, of valve components of the pump assembly of FIG. 1.

Valve 64 has a valving spool 86 ,moveable between first and second positions shown in FIG. 1 and an intermediate null position shown in FIG. 2. In the first position work port 82 is connected to drain port 78 to vent hydraulic or pressure chamber 52 in inlet throttle valve 20 directly to the sump and inlet port 76 is closed. In the second position drain port 78 is closed and the inlet port 76 is connected to work port 82 to flow high-pressure oil from passage 18 directly to the pressure chamber in the inlet throttle valve. The full output pressure acts on the inlet throttle valve spool to shift the spool toward the closed position against spring 46 and inlet pressure.

Spring 88 and the pressure of oil in line 74 downstream of restriction 70, bias spool 86 toward the first position, as indicated in FIG. 1. High-pressure fluid in line 66 biases the spool toward the second position. Both ends of the spool have the same area so that when there is no pressure drop across restriction 70, spring 88 holds the spool in the first position, chamber 52 is vented to sump and the inlet throttle valve is open. When the pressure in line 74 is reduced by opening valve 62 to flow fluid in line 74 to sump, there is a pressure drop across restriction 70 and the pressure in line 66 shifts spool 86 toward the second position.

Pilot relief valve 62 includes solenoid 90 which is actuated by a current signal from the ECM. The valve includes a spool or pin 92 that is acted upon by the pressure of oil in line 72 to open the valve. The solenoid, in response to the signal from the ECM, biases the spool toward a closed position as illustrated.

The regulator valve 60 includes inlet opening 68 in line 28, drain opening 94 in drain line 80 leading to sump 14, and work opening 96 in line 84 leading to the inlet throttle valve 20.

Assembly 10 includes a conventional high-pressure mechanical relief valve 98 that opens in response to transient over pressure in passage 18 to flow high-pressure oil directly to sump 14 and reduce the over-pressure. The assembly also includes a conventional makeup check valve 100. Valve 100 permits flow of makeup oil into the high-pressure passage when the engine is shut off and cools.

FIG. 2 is a sectional view through regulator valve 60. The valve has a body 102 housing valves 62 and 64. Body 102 has a stepped cylindrical recess 104 extending into one side of the body with the port end 106 of the recess communicating with inlet port 76. Radial passage 108 extends from the recess to work port 82 and radial passage 110 extends from the recess to drain port 78. Hollow, generally cylindrical body 112 is threaded into recess 104.

Solenoid 90 is mounted on the outer end of body 102, outside of body 112. The solenoid includes coil 114, which surrounds armature 115. The armature engages rod 116 which is slideably mounted in solenoid insert 118.

Valve insert 120 is mounted in recess 104 in body 102 and defines a cylindrical valving bore 122 extending from the port end 106 of the recess 104 to cap 124 confined between inserts 118 and 120. The cap closes the end of bore 122 adjacent the solenoid. A small diameter valving passage 126 extends through cap 124 to communicate bore 122 with chamber 128 formed in solenoid insert 118. Passage 130 communicates chamber 128 with cylindrical chamber 132 surrounding insert 120 and in flow communication with passage 110 leading to drain port 78.

Cap 124 slideably supports spool or pin 92 of valve 62. The pin is held between rod 116 and one end of valving passage 126. The pin is larger than passage 126. Energization of solenoid 90 by a current signal from the ECM biases the armature 115 against rod 116 and the rod against pin 92 to bias the pin toward the cap. The pressure of the oil in valving passage 122 biases the pin in the opposite direction.

Hollow cylindrical valve spool 86 is slideably fitted in bore 122 and includes an open end adjacent cap 124 and piston 134 adjacent port end 106. Restriction or bleed opening 70 extends through piston 134 to the interior of the spool. The spool is located in bore 122 between cap 124 and the inner end of cylindrical stop 136 fitted in the end of bore 122 adjacent port 76. Spring 88 is confined between cap 124 and an interior step in spool 86 to bias the spool toward stop 136.

Narrow, cylindrical valving land 138 extends around the end of spool 86 at piston 134. Land 138 extends from the piston to a circumferential recess 140 formed in the spool and has a close sliding fit in bore 122. One or more openings 142 extend through insert 120 to communicate recess 140 with chamber 132 at all times.

Figure 3:
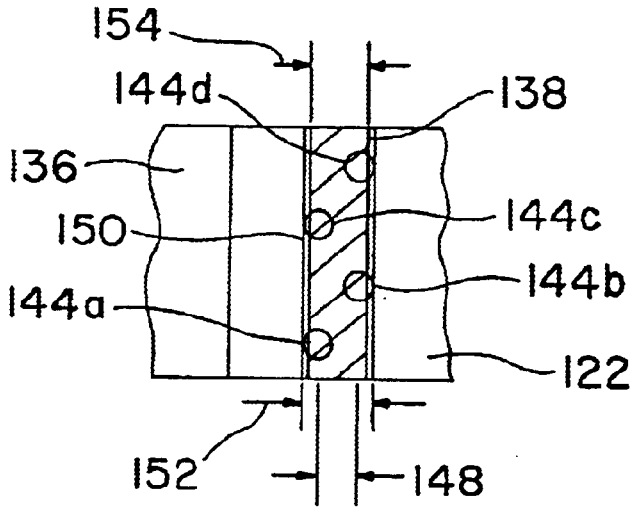
FIG. 3 is a flattened view of an interior cylindrical surface of a valving bore in the assembly.

Four like, small diameter cylindrical valving passages 144*a*, 144*b*, 144*c* and 144*d* extend through insert 120 and open into bore 122 a short distance outwardly from stop 136. Passages 144 open into chamber 146 and passage 108 leading to work port 82. The passages 144 are spaced apart 90 degrees from each other around the wall of bore 122 and are spaced axially or offset a short distance along the bore as illustrated in FIG. 3. Flow passages 144*a* and 144*c* are diametrically opposed and in line with each other in bore 122. Likewise, passages 144*b* and 144*d* are diametrically opposed and in line with each other. Passages 144*a* and 144*c* are axially offset from passages 144*b* and 144*d* in bore 122.

The bore 122 may have a diameter of 0.250 inches with valving passages 144 having diameters of 0.047 inches. The centers of passages 144*a* and 144*c* are axially spaced from the centers of passages 144*b* and 144*d* by a distance 148 of 0.035 inches so that the passages 144 are located within a circumferential band 150 extending around bore 122 and having a width 152 of 0.082 inches. Valving land 138 on spool 86 has a width of 0.076 inches so that when the spool is in the null position shown in FIG. 2, the land overlies passages 144 with an underlap of approximately 0.0015 inches at passages 144*a* and 144*c* and an underlap of 0.0045 inches at passages 144*b* and 144*d*. When the spool in the null position, flow through underlapped passages 144*a* and 144*c* equals flow through underlapped passages 144*b* and 144*d*. Because the pressure drop across passages 144*a* and 144*c* on the high-pressure side of piston 134 is greater than the pressure drop across passages 144*b* and 144*d* on the low pressure side of piston 134, passages 144*a* and 144*c* are underlapped less than passages 144*b* and 144*d*. The underlaps shown are for a null position at high output pressure. The null position for a reduced output pressure would have a larger underlap at passages 144*a* and 144*c* and a smaller underlap at passages 144*b* and 144*d*.

The small diameters of passages 144 means that the flow areas through the passages increases and decreases relatively slowly as an edge of the valving land 138 moves across the passages, thus providing relatively gradual increase of high-pressure flow through the passages to the inlet throttle valve 20 during opening. Slow opening of the passages improves the stability of inlet throttle valve. Large passages having a diameter equal to the full width of band 150 would increase and decrease the flow area undesirably rapidly as land 138 moves across the passages.

The pressure of oil on the high-pressure side of piston 134 may be as high as 4,060 pounds per square inch. When the valving spool is moved toward cap 124 against spring 88 and partially opens passages 144, the oil exerts radial pressure on exposed portions of land 138. Since the diametrically opposed passages 144 are in line with each other, radial forces are balanced. For instance, movement of spool 86 to the right of the position shown in FIG. 2 opens passages 144*a* and 144*c* and the high-pressure oil exerts equal and opposite forces on the portions of the valving land overlying the passages. Thus, there are insignificant radial forces acting on spool 86, with minimum friction and spool/bore wear.

Land 138 underlaps passages 144 and substantially closes the passages when in the null position. In addition, passages 144*a* and 144*c* may be smaller in diameter that passages 144*b* and 144*d* to improve the gradual change of flow area from outlet pressure to work port 82 relative to gradual change of flow area from the work port 82 to sump. If desired, the land may have a width sufficient to completely cover the passages, so that the land completely closes the passages when in the null position.

The operation of pump assembly 10 will now be described.

Before startup of the engine main stage valve 64 is in the first position indicated in FIG. 1 with spring 88 holding spool 86 against stop 136 and passage 108 is connected to passage 110. With the hydraulic chamber 52 of the inlet throttle valve connected to the sump through passages 108 and 110, spring 46 holds the inlet throttle valve spool in the full open position for maximum flow of inlet oil to the high-pressure pump and rapid increase of pressure in outlet passage 18.

When the engine has been started, the pressure in outlet passage 18 is typically less than the desired pressure in the passage so that the ECM sends a high current signal to solenoid 90 to bias pin 92 against passage 126 and close the passage. In the absence of flow through the passage, there is no flow through restriction 70, no pressure drop across piston 134 and no force exerted on the piston to move spool 86 away from stop 136. Spring 88 continues to hold spool 86 against the stop. Valving land 138 remains positioned to the left of passages 144 preventing flow of high-pressure outlet oil through the passages and to the inlet throttle valve. The inlet valve stays fully open and pressure in passage 18 rapidly increases.

As pressure builds in passage 18 the difference between the actual output pressure and the desired output pressure decreases and the ECM signal to solenoid 90 decreases, reducing the force exerted on pin 92 by the solenoid. The reduction of this force, together with the increase of pressure in bore 122 moves pin 92 away from cap 124 sufficiently to permit flow past the pin to passages 130 and 110 and to the sump. High-pressure fluid flows into the spool through restriction 70 in piston 134. The pressure drop across the piston biases the piston to the right, as shown in FIG. 2, away from stop 136 against the force exerted by spring 88. As land 138 moves away from stop 136 it gradually closes passages 144. This occurs until the land is in the null position, the output pressure in passage 18 is equal to the desired pressure and the inlet throttle valve spool 38 has reached a pressure balance position.

When the pressure in passage 18 is greater than the desired pressure the ECM signal is decreased, further increasing flow through passage 126 and increasing the pressure on piston 134 to shift spool 86 away from stop 136. Further movement of the spool moves land 138 past passages 144 to open the passages to flow of high-pressure oil directly from the output passage 18 to hydraulic chamber 52 in the inlet throttle valve, increase the pressure in the chamber and shift the inlet throttle valve spool 38 toward the partially closed position. Venting of the inlet throttle valve to sump is cut off.

As the pressure in passage 18 approaches the desired pressure, the signals to solenoid 52 either increase or decrease until the desired pressure is achieved, the inlet throttle valve spool has reached a pressure balance position and land 138 is in the null position shown in FIG. 2 to substantially or fully close passages 112 to the pressure chamber in the inlet throttle valve.

When desired output pressure changes, the ECM signal changes and the spools of valves 20 and 64 modulate with spool 86 returning to the null position and inlet throttle valve spool 38 stabilizing at a new equilibrium position.

Full output pressure in passage 18 is applied directly to the inlet throttle spool to shift the spool and close the valve. Applying full output pressure to the inlet throttle valve spool is important when the engine is operating at a rotational low speed and the full output pressure is relatively low, yet sufficiently high to rapidly shift the inlet throttle spool 92 against spring 46 and inlet pressure in response to signals received from the ECM. For instance, pump assembly 10 may be mounted on a diesel engine used in a light truck or a passenger vehicle where the rotational speed of the engine is rapidly and frequently increased and decreased through an operating range extending from idle to a high speed maximum and where the output pressure at low speed is considerably less than the output pressure at high speed. Regulator valve 60 utilizes available output pressure to close the inlet throttle valve spool quickly and stably. The hydraulic stop for spool 38 provided by drain port 58 prevents output pressure from moving the spool into contact with stop 136. Valve 60 allows the inlet throttle valve spring and inlet pressure to shift the spool rapidly to the open position by directly venting the pressure chamber in the valve to the sump. Valve 60 permits rapid response of the inlet throttle valve to changes in the ECM signal over the RPM range of the engine and improves inlet throttle valve stability and fuel economy.

At the equilibrium or null position of valve 60, shown in FIG. 2 and indicated in FIG. 3, land 138 is positioned over and underlaps the four valving passages 144. Small portions of passages 144*a* and 144*c* on the high-pressure side of land 138 are open and small portions of passages 144*b* and 144*d* on the low-pressure side of land 138 are open. The underlap shown in FIG. 3 is exaggerated for purposes of illustration. The open portions of passages 144*a* and 144*c* may be 0.0015 inches wide and the open portions of passages 144*b* and 144*c* may be 0.0045 inches wide.

When the land 138 is in the null position the uncovered or untapped portions of passages 144*a* and 144*c* communicate with the small area untapped portions of passages 144*b* and 144*d* through chamber 146. The untapped openings permit limited flow of high-pressure oil at output pressure from passage 18 through the untapped portions of passages 144*a* and 144*c*, chamber 146, untapped portions of passages 144*b* and 144*d*, and to sump 14. The small area underlap bleed passages desensitize inlet throttle valve spool 38 to pressure spikes in outlet passage 18. The full force of the pressure spike is not transmitted to the inlet throttle valve. The bleed passages communicate port 76 to the sump to dampen pressure oscillation of the inlet throttle valve spool in response to pressure spikes and improve stability of the inlet throttle valve.

Regulator valve 60 does not respond to overpressures in passage 18 by dumping high-pressure oil directly to the sump with consequent energy loss when the oil is depressurized. Rather, an overpressure insufficient to open valve 98 shifts main stage valve 64 to flow high-pressure fluid through line 84 to the inlet throttle valve and shift the valve toward the closed position and reduce input to high-pressure pump 22. Reduced input reduces the volume of oil pumped into passage 18 and reduces output pressure. Underlapping of openings 144 by valving land 138 provides limited direct flow to the sump to reduce instability of the inlet throttle valve.

Alternate connection of the inlet throttle valve chamber 52 directly to output pressure or to the sump permits rapid flow of oil into and out of the chamber to move the inlet throttle valve spool rapidly in response to signals from the ECM and reduces the time required to increase or decrease the pressure in the outlet passage 18 to match the desired output pressure as determined by the ECM. Rapid output pressure response is particularly valuable in diesel engines where the speed of the engine may quickly vary from idle, with a low output pressure of about 360 PSI to maximum engine speed with output pressure as great as 4,060 PSI.

Figure 5:
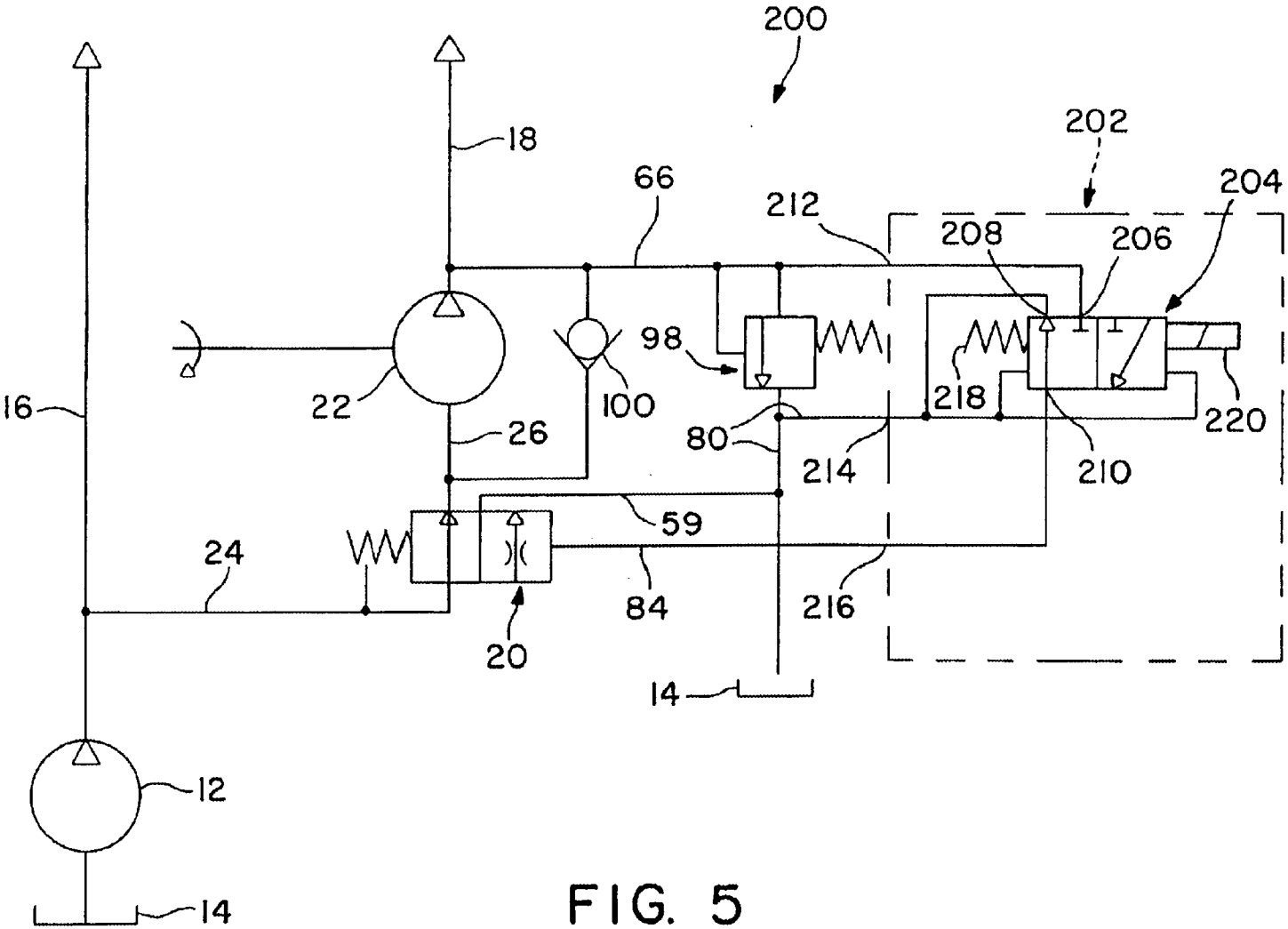
FIGS. 5 and 6 are diagrams of hydraulic circuitry of second and third embodiment pump assemblies.

FIG. 5 illustrates a second embodiment pump assembly 200 which is identical to assembly 10 except that the assembly uses a regulator valve 202 different from regulator valve 60. Other components of pump assembly 200 are identical to the prior described components of assembly 10 and are identified in FIG. 5 by the same reference numbers used in FIG. 1.

Regulator valve 202 includes a single solenoid three-way valve 204 having inlet port 206, drain or exhaust port 208 and work port 210. These ports are respectively connected to regulator valve inlet opening 212, drain opening 214 and work opening 216, corresponding to openings 68, 94 and 96 of regulator valve 60.

Valve 204 includes a valving spool (not illustrated) having a pressure piston with a cylindrical valving land moveable along a valving bore as in valve 38. The piston is imperforate. Four cylindrical valving passages open into the bore and are arranged in opposed, spaced pairs, like passages 144 previously described. The valving land is underlapped with regard to the valving passages, as previously described. If desired, the land may completely cover the valving passages.

Spring 218 biases the spool toward a first position, previously described, where work port 210 is connected to drain port 208 and the pressure chamber 52 in inlet throttle valve 20 is connected to the sump through lines 84, valve 204 and line 80.

The valve has a second position, previously described, where the inlet port 206 is connected to work port 210 to flow high-pressure oil from passage 18 directly to the pressure chamber of the inlet throttle valve through line 84.

Valve 204 has a null position, as previously described, with the spool land underlapping or closing the valving passages. The position is the same as indicated in FIG. 3 and previously described. The solenoid force biases the spool against the force of spring 218 to shift the spool in the valve bore relative to the small valving passages like passages 144 described previously.

The valve 204 includes a fast acting proportional solenoid 220 having an armature engaging the spool. The solenoid biases the spool toward the second position. The coil of solenoid 220 receives a steady state current signal from the engine ECM to maintain the spool in a null position. Current is increased or decreased proportional to the difference between the desired output pressure in line 18, as calculated by the ECM, and the actual outlet pressure in line 18. This signal generates a force biasing the spool toward the second valve position. When the solenoid force is greater than the spring force the spool shifts toward the second position and high-pressure oil from line 18 is flowed directly to the inlet throttle valve to rapidly move the inlet throttle valve toward the closed position. When the solenoid force is less than the spring force the spool shifts toward the first position and the inlet throttle valve opens.

In valve 204, the spool has a central piston carrying the valving land and end pistons spaced to either side of the central piston. The outer ends of the valving bore are connected to sump 14 through passage 80 and are at the same low-pressure. Both ends of the spool have the same area. This assures that the movement of the spool along the valving bore is influenced by spring 218 and solenoid 220 and is not influenced by pressure differentials at the ends of the spool.

Figure 6:
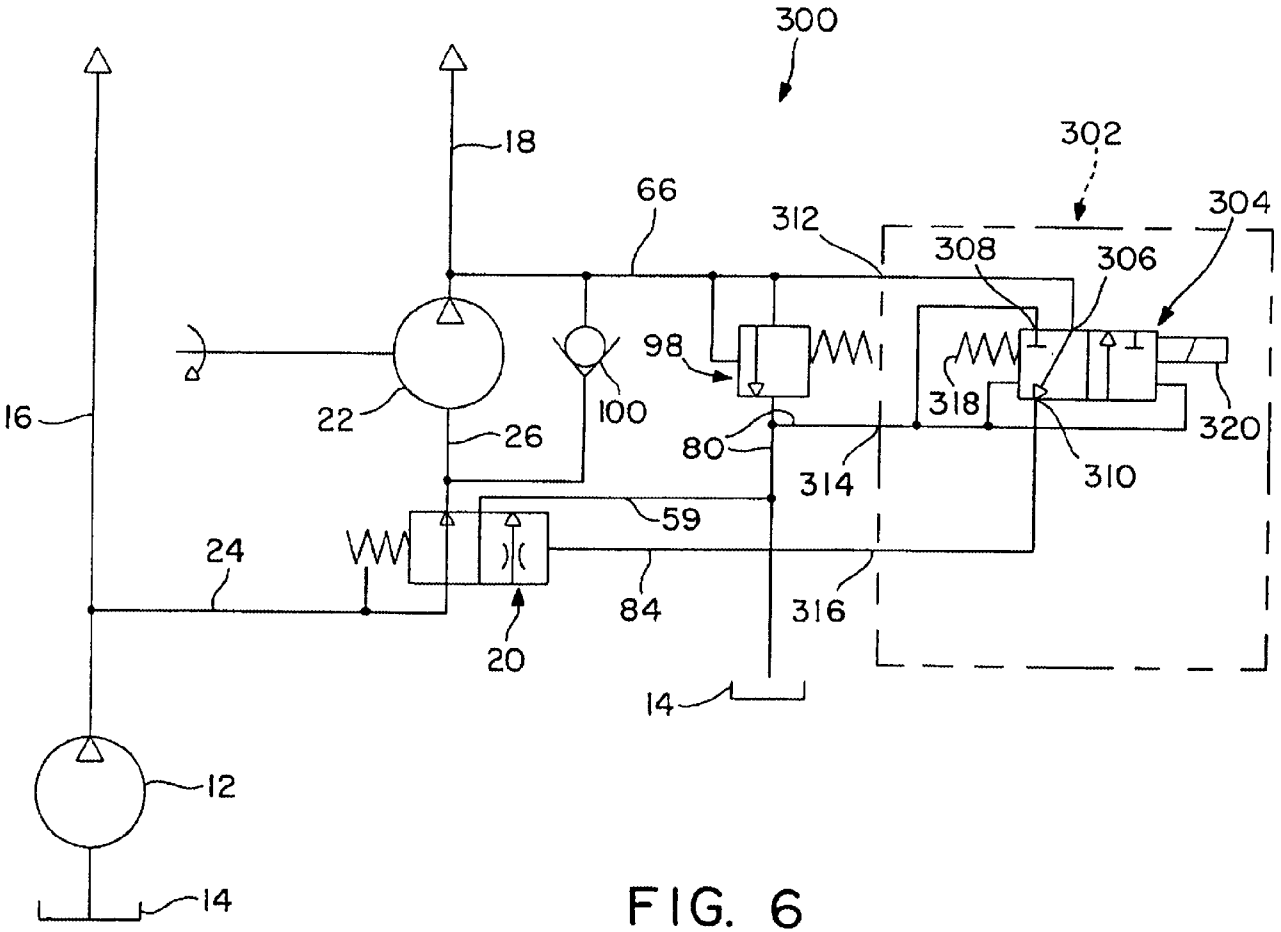

FIG. 6 illustrates a third embodiment pump assembly 300 which is identical to assembly 200 except that assembly 300 uses a regulator valve 302 different from regulator valve 202. Other components of pump assembly 300 are identical to the prior described components of assembly 10 and are identified in FIG. 6 by the same reference numbers used in FIG. 1.

Regulator valve 302 includes a single solenoid three-way valve 304 having inlet port 306, drain or exhaust port 308 and work port 310 like ports 206, 208 and 210. These ports are respectively connected to regulator valve inlet opening 312, drain opening 314 and work opening 316, like openings 212, 214 and 216.

Valve 304 includes a valving spool (not illustrated) having a pressure piston with a cylindrical valving land moveable along a valve bore, as in valve 204. The piston is imperforate. Four cylindrical valving passages open into the bore and are arranged in opposed, spaced pairs like passages 144 previously described. The valving land is underlapped with regard to the passages, as also previously described. If desired, the land may completely cover the valving passages.

Valve 304 includes a fast acting proportional solenoid 320 which engages the spool. Solenoid 320 is like solenoid 220, previously described. The solenoid biases the spool toward a first position in which inlet port 306 is closed and work port 310 is connected to drain port 308 so that the spring of the inlet throttle valve 20 holds the inlet throttle valve in a full open position.

Spring 318 of valve 304 biases the spool toward a second position where work port 310 is connected to inlet port 306 and drain port 308 is closed. When the spool is in this position high-pressure oil from outlet passage 18 is flowed directly to inlet throttle valve 20 to close the inlet throttle valve and reduce inlet flow to pump 22 to minimum or idle flow.

Valve 304 has a null position in which the spool land underlaps or closes the valving passages. This position is the same as indicated in FIG. 3 and previously described.

In valve 304 the ends of the valving bore are connected to sump 14 through passage 80 and are at the same low pressure. The spool includes end pistons having the same area and assuring that movement of the spool along the valving bore is influenced by spring 318 and solenoid 320 and is not influenced by pressure differentials at the ends of the spool.

The coil of solenoid 320 receives a steady state current signal from the engine ECM to maintain the spool in a null position. Current is increased when the output pressure is lower than desired to shift valve 304 toward the first position and open the inlet throttle valve to increase flow to pump 22 and increase output pressure. Conversely, current is decreased when output pressure is greater than desired to shift valve 304 toward the second position, close valve 20 and increase output pressure.

The spool of valve 304 is moved to a null position when the output pressure equals the desired output pressure, as previously described and solenoid 320 holds the spool against the spring with the piston underlapping or closing the passages opening into the valving bore.

In the third embodiment of FIG. 6, failure of solenoid 320 allows spring 318 to shift the three-way valve spool to the second position and connect inlet port 306 to work port 310. High-pressure output oil is supplied directly to the inlet throttle valve, shifting the valve to the closed position and reducing inlet flow to pump 22 to an idle level. Pump assembly 300 facilitates rapid shut down of the engine in the event the solenoid 320 fails.

In the embodiment shown in FIG. 6, spring 318 can be replaced by a piston acted upon by outlet pressure from passage 18. The solenoid force biases the spool against the force of outlet pressure acting on the piston to shift the valve spool in the valve bore relative to the small valving passages like passages 144 described previously. In this case, outlet pressure is proportional to current to solenoid 320. Current is increased or decreased proportional to the difference between the desired output pressure in line 18, as calculated by the ECM, and the actual outlet pressure in line 18.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention:

1. A pump assembly for an internal combustion engine of the type having one or more devices actuated by high-pressure liquid, an outlet passage connected to the one or more devices, a source of liquid, and an ECM; the pump assembly comprising a variable output high-pressure pump having a pump inlet port, and a pump outlet port connected to the outlet passage; a hydraulic inlet throttle valve having an inlet throttle valve inlet port connected to the source, an inlet throttle valve outlet port connected to the pump inlet port, a first spool moveable between an open position and a closed position, a spring biasing the first spool toward the open position, such spool including an inlet throttle valve piston forming one wall of a hydraulic chamber wherein the pressure of liquid in the chamber biases the first spool toward the closed position; a three-way valve having a three-way valve inlet port connected to the outlet passage, a three-way valve drain port connected to the source, a work port connected to the hydraulic chamber of the inlet throttle valve, and a second spool moveable between a first position in which the work port is connected to the drain port, a null position in which the work port is closed or substantially closed, and a second position in which the work port is connected to the three-way valve inlet port; and first means for shifting the second spool toward the first position when the pressure in the outlet passage is less than the desired pressure in the outlet passage, for maintaining the three-way valve spool in the null position when the pressure in the outlet passage is equal to the desired pressure in the outlet passage, and for shifting the three-way valve spool toward the second position when the pressure in the outlet passage is greater than the desired pressure in the outlet passage.

2. The pump assembly as in claim 1 wherein said first means comprises a first passage extending from said outlet passage to one end of the three-way valve spool, a second passage extending from said outlet passage to the other end of the three-way valve spool, a third passage extending from the second passage to the source, and a pilot operated valve in said third passage responsive to a signal from the ECM to open the third passage and reduce hydraulic pressure at the other end of the three-way valve spool.

3. The pump assembly as in claim 2 including a restriction in the second passage.

4. The pump assembly as in claim 3 wherein the pilot operated valve comprises a solenoid.

5. The pump assembly as in claim 4 wherein the restriction is located between the outlet passage and the third passage.

6. The pump assembly as in claim 2 wherein said three-way valve includes a spring biasing the second spool toward said first position.

7. The pump assembly as in claim 2 wherein said three-way valve includes a spring biasing the second spool toward said second position.

8. The pump assembly as in claim 1 wherein said first means comprises a solenoid responsive to a signal from the ECM.

9. The pump assembly as in claim 8 wherein said first means comprises a spring for biasing the three-way valve spool toward one of said first and second positions.

10. The pump assembly as in claim 1 wherein said three-way valve includes a valving bore; valving passage means opening into said bore, said valving passage means having an axial width along the bore; and said second valve spool including a valving land having a land width less than said valving passage means axial width, wherein the valving passage means is underlapped when the second spool is in the null position.

11. The pump assembly as in claim 10 wherein said valving passage means comprise a number of passages each having an axial extent less than said valving passage means axial width.

12. The pump assembly as in claim 1 wherein said three-way valve spool includes a piston and a restriction extending through the piston.

13. The pump assembly as in claim 12 wherein said three-way valve includes a spring biasing said three-way valve spool along said valving bore toward said first position.

14. The pump assembly as in claim 12 wherein said three-way valve includes a spring biasing said three-way valve spool along said valving bore toward said second position.

15. The pump assembly as in claim 1 wherein said first means comprises a solenoid responsive to a signal from the ECM, said solenoid including an armature biasing said second spool in a first direction.

16. The pump assembly as in claim 15 wherein the three-way valve includes a three-way valve spring biasing the second spool in a second direction opposite to said first direction.

17. The pump assembly as in claim 16 wherein said solenoid biases the three-way valve spool toward the first position and the three-way valve spring biases the three-way valve spool toward the second position.

18. The pump assembly as in claim 16 wherein both ends of the three-way valve spool have the same area; and including a passage connecting such ends together.

19. The pump assembly as in claim 16 wherein said three-way valve spring biases the second spool toward said first position and said solenoid biases the three-way valve spool toward said second position.

20. The pump assembly as in claim 1 wherein the inlet throttle valve inlet port opens directly to said inlet throttle valve piston so that hydraulic pressure of liquid supplied to the inlet throttle valve biases the first spool toward the open position.

21. The pump assembly as in claim 1 wherein the three-way valve includes a spring biasing the three-way valve spool toward one position and a piston biasing the three-way valve spool toward the other position.

22. The pump assembly as in claim 1 wherein the inlet throttle valve includes hydraulic stop means for preventing the first spool from contacting part of the inlet throttle valve when such spool is moved to the closed position.

23. The pump assembly as in claim 22 wherein the hydraulic stop means includes a drain port communicating with the chamber only when the inlet throttle valve spool is closed.

24. A pump assembly for an internal combustion engine of the type having one or more devices actuated by high-pressure liquid, an outlet passage connected to the one or more devices, a source of liquid, and an ECM; the pump assembly comprising a variable output high-pressure pump having a pump inlet port, and a pump outlet port connected to the outlet passage; a hydraulic inlet throttle valve having an inlet throttle valve inlet port connected to the source, an inlet throttle valve outlet port connected to the pump inlet port, an inlet throttle valve spool moveable between an open position and a closed position, a first spring biasing the inlet throttle valve spool toward one of said positions, such spool including an inlet throttle valve piston forming one wall of a hydraulic chamber wherein the pressure of liquid in the chamber biases the spool toward the other of said positions; a three-way valve having a three-way valve inlet port connected to the outlet passage, a three-way valve drain port connected to the source, a work port connected to the hydraulic chamber of the inlet throttle valve, and a three-way valve spool moveable between a first position in which the work port is connected to the drain port and a second position in which the work port is connected to the three-way valve inlet port; and means for shifting the three-way valve spool toward the first position when the pressure in the outlet passage is less than the desired pressure in the outlet passage and for shifting the three-way valve spool toward the second position when the pressure in the outlet passage is greater than the desired pressure in the outlet passage.

25. The pump assembly as in claim 24 wherein said first spring biases the inlet throttle spool toward the open position and the pressure of liquid in the chamber biases such spool toward the closed position.

26. The pump assembly as in claim 24 wherein the three-way valve has a null position in which the work port is closed or substantially closed.

27. The pump assembly as in claim 24 wherein said means comprises a second spring biasing the three-way valve spool toward one of said portions.

28. The pump assembly as in claim 27 wherein the second spring biases the three-way valve spool toward the second position.

29. The method of controlling the pressure of an actuating liquid in an internal combustion engine having one or more hydraulically actuated devices, a high-pressure pump for supplying liquid at output pressure to the one or more hydraulically actuated devices, a source of low-pressure liquid, a hydraulic inlet throttle valve for supplying liquid from the source to the pump, the inlet throttle valve having an inlet throttle valve spool with a piston facing a hydraulic chamber so that the pressure of liquid in the chamber biases the spool toward a closed position, and a spring biasing the inlet throttle valve spool toward an open position, comprising the steps of:

a) connecting the hydraulic chamber directly to the source when the actual outlet pressure of the pump is less than the desired outlet pressure so that the spring shifts the inlet throttle valve spool toward the open position and liquid in the hydraulic chamber drains directly to the source to increase inlet flow of liquid to the pump and increase outlet pressure;

b) connecting the hydraulic chamber directly to the output of the pump when the actual outlet pressure is greater than the desired outlet pressure so that liquid in the hydraulic chamber at outlet pressure shifts the spool toward the closed position to decrease inlet flow of liquid to the pump and decrease outlet pressure; and c) preventing or substantially preventing flow of liquid to or from the hydraulic chamber when the actual outlet pressure is equal to the desired outlet pressure so that the position of the inlet throttle valve is maintained.

30. The method of claim 29 including the step of:

d) damping the inlet throttle valve from spikes in outlet pressure by flowing liquid at outlet pressure to the source.

31. The method of claim 29 wherein the internal combustion engine includes a three-way valve having an inlet port connected to the output of the pump, a drain port connected to the source, a work port connected to the inlet throttle valve chamber and a spool having a valving land moveable across a passage leading to the work port, including the step of:

d) underlapping such passage by positioning the land over the passage with portions of the passage located to either side of the land to permit limited flow of liquid from one side of the land to the other side of the land.

32. The method of claim 29 including the step of:

d) moving the inlet throttle valve spool toward the closed position and venting the chamber to the source before the inlet throttle valve spool physically engages portion of the inlet throttle valve.

33. The method of claim 29 wherein the inlet throttle valve is controlled by a solenoid, including the step of:

d) moving the inlet throttle spool to the closed position when the solenoid fails.

34. The method of claim 29 wherein the internal combustion engine includes a three-way valve having an inlet port connected to the outlet of the pump, a drain port, a work port connected to the inlet throttle valve chamber and a three-way valve spool having a land moveable across a passage leading to the work port; a solenoid engaging the three-way valve spool; and an ECM, comprising the steps of:

d) biasing the three-way valve spool in a first direction by actuating the solenoid in response to a signal from the ECM, e) biasing the three-way valve spool in a second direction opposite to the first direction, and f) moving the three-way valve spool to a null position overlying or substantially overlying the passage when actual outlet pressure substantially equals desired outlet pressure.

35. The method of claim 34 including the step of:

g) biasing the three-way valve spool in the second direction by a spring.

36. The method of claim 34 including the step of:

g) biasing the three-way value spool in the second direction by a pressure liquid.

37. The method of claim 36 including the step of:

h) biasing the three-way value spool in the second direction by liquid at outlet pressure.

38. The pump assembly as in claim 1 wherein said first means comprises a piston at one end of the second spool, such piston opening into a pressure chamber, and a passage extending from the pump outlet port to such chamber, wherein liquid at outlet pressure biases the second spool toward one of said positions.

39. The pump assembly as in claim 38 wherein liquid at outlet pressure biases the second spool toward the second position.

* * * * *

UNITED STATES PATENT AND TRADEMARK OFFICE

CERTIFICATE OF CORRECTION

PATENT NO. : 6,647,965 B1
DATED : November 18, 2003
INVENTOR(S) : Robert H. Breeden It is certified that error appears in the above-identified patent and that said Letters Patent is hereby corrected as shown below:

Column 3,
Line 52, delete the comma between “of” and “the”.

Column 4,
Line 41, delete the comma between “86” and “moveable”.

Column 8,
Lines 26, 27, 28, 30 and 31, replace “untapped” with -- unlapped --.

Column 14,
Lines 48 and 51, replace “value” with -- valve --.

Signed and Sealed this

Thirtieth Day of December, 2003

JAMES E. ROGAN
*Director of the United States Patent and Trademark Office*